US007235727B2

(12) United States Patent
Fujiwara

(10) Patent No.: US 7,235,727 B2
(45) Date of Patent: Jun. 26, 2007

(54) AUTOMATIC PIANO, AND METHOD AND PROGRAM FOR AUTOMATICALLY OPERATING A KEY

(75) Inventor: Yuji Fujiwara, Shizuoka-ken (JP)

(73) Assignee: Yamaha Corporation, Shizuoka-Ken (JP)

( * ) Notice: Subject to any disclaimer, the term of this patent is extended or adjusted under 35 U.S.C. 154(b) by 138 days.

(21) Appl. No.: 11/077,393

(22) Filed: Mar. 10, 2005

(65) Prior Publication Data

US 2005/0211050 A1 Sep. 29, 2005

(30) Foreign Application Priority Data

Mar. 12, 2004 (JP) ..... 2004-071043

(51) Int. Cl.
*G10F 1/02* (2006.01)

(52) U.S. Cl. ..... 84/23; 84/19; 84/21; 84/744

(58) Field of Classification Search ..... None
See application file for complete search history.

(56) References Cited

U.S. PATENT DOCUMENTS 5,451,708 A * 9/1995 Fujiwara et al. ..... 84/21
5,652,399 A 7/1997 Fujiwara et al.
5,691,489 A * 11/1997 Fujiwara et al. ..... 84/21
6,407,321 B2 * 6/2002 Tamaki et al. ..... 84/20

FOREIGN PATENT DOCUMENTS

JP 07-175472 7/1995
JP 9-81125 3/1997

* cited by examiner

*Primary Examiner*—Marlon Fletcher
(74) *Attorney, Agent, or Firm*—Harness, Dickey & Pierce, PLC

(57) ABSTRACT

In order to define movement of a particular key to be automatically operated, first-order trajectory data are generated, on the basis of performance information, which are indicative of variation over time of position, velocity and acceleration components of the particular key. Jerk component related to the movement of the particular key is calculated on the basis of the acceleration component in the first-order trajectory data, and second-order trajectory data are generated by modifying the first-order trajectory data with the calculated jerk component. Then, a drive device for driving the particular key is servo-controlled on the basis of the second-order trajectory data. In this way, nonconstant acceleration (or constant jerk) control, rather than constant acceleration control, can be performed to control driving of the key during a successive key depression, so as to allow the successively-depressed key to operate with an increased smoothness.

7 Claims, 5 Drawing Sheets

AUTOMATIC PIANO, AND METHOD AND PROGRAM FOR AUTOMATICALLY OPERATING A KEY

BACKGROUND OF THE INVENTION

The present invention relates to an automatic piano for performing music through automatic driving of a keyboard and a method and program for automatically operating a key on a keyboard. More particularly, the present invention relates to a technique for improving the reproducibility of a music performance executed by successive key depression operation.

Generally, automatic pianos execute an automatic performance by selectively exciting solenoids, provided in corresponding relation to keys of an acoustic piano, on the basis of performance information, to thereby drive the corresponding keys so that hammers corresponding to the driven keys strike corresponding strings; in this way, an automatic performance of the automatic piano is executed. String striking intensity of the hammer corresponds to a driven velocity of the key that in turn corresponds to a level of a current supplied to the solenoid. In order to reproduce a performance executed through key depression operation by a human player on such an automatic piano, it is desirable to accurately reproduce trajectories of individual keys during the performance so as to expressively describe delicate nuances of the music piece and expression of tones. In this regard, some of the conventionally-known automatic piano are constructed to, on the basis of performance data to be reproduced, determine velocity information (i.e., reference velocities) at predetermined points (i.e., reference points) along a movement trajectory of each of the keys, generate trajectory data of the key corresponding to a desired trajectory type (linear, parabolic or the like), and then drive the corresponding solenoid in accordance with the trajectory data (for example, Japanese Patent Application Laid-open Publication No. HEI-7-175472). Further, among the conventionally-known automatic pianos of the above-mentioned type are one which is constructed to reproduce a so-called half-stroke performance where release operation of a key is started before the key is completely depressed to its lower end position or where depression operation of a next key is started during depression operation of a key. More specifically, this conventional automatic pianos calculates, along with trajectory data of linear trajectories (constant velocity trajectory) during depression and release operation of a key, a "shortcut (or shortened) trajectory" corresponding to a second-order curve representative of velocity variation of the key and drives the key, in accordance with the calculated shortcut trajectory, during a transition from the depression phase to the release phase of the key, so as to continuously vary the velocity of the key (for example, Japanese Patent Application Laid-open Publication No. HEI-9-81125).

However, in performance reproduction by the conventional automatic pianos, where an operating velocity of a key is to be varied rapidly, particularly where a key is to be depressed in rapid succession, to reproduce, for example, a half-stroke performance, the key tends to get out of control easily, and various inconveniences, such as an excessive increase in the string striking intensity of the hammer, would result. The No. HEI-9-81125 publication proposes avoiding these inconveniences by controlling a key, for example in a half-stroke performance, to move along the shortcut trajectory before the stroke position of the key reaches an intersection between the depressing trajectory and the releasing trajectory. However, if the key is driven in accordance with the shortcut trajectory as disclosed in the publication, the key stroke amplitude unavoidably decreases, which undesirably tends to key depression errors and insufficient successive-key-depression capability.

SUMMARY OF THE INVENTION

In view of the foregoing, it is an object of the present invention to provide an improved automatic piano which allows a key to be successively depressed with an increased smoothness and can reproduce expressive performance nuances and tone colors. It is another object of the present invention to provide a method and program for automatically operating a key in such an automatic piano.

According to an aspect of the present invention, there is provided an improved automatic piano, which comprises: a plurality of keys; a drive device that individually drives the plurality of keys; a first-order trajectory data generation section that, on the basis of performance information, generates first-order trajectory data indicative of variation over time of position, velocity and acceleration components of a particular one of the keys to be automatically operated, in order to define movement of the particular key; a second-order trajectory data generation section that, on the basis of the acceleration component in the first-order trajectory data, calculates a jerk component related to the movement of the particular key, modifies the first-order trajectory data with the calculated jerk component and generates the modified first-order trajectory data as second-order trajectory data; and a control device that, on the basis of the second-order trajectory data, urges the drive device to drive the particular key. Thus, in the present invention, the particular key is automatically operated along a trajectory corresponding to the second-order trajectory data.

In other words, the present invention is characterized by: calculating a jerk component about the movement of the particular key on the basis of the acceleration component in the first-order trajectory data, without directly using the first-order trajectory data generated in accordance with the conventionally-known scheme; generating the second-order trajectory data by modifying the first-order trajectory data with the calculated jerk component; and then automatically driving (i.e., operating) the particular key along a trajectory corresponding to the second-order trajectory data. For example, a trajectory represented by the first-order trajectory data includes a constant acceleration section, and the second-order trajectory data generation section calculates the jerk component, on the basis of an acceleration component in the constant acceleration section, such that the acceleration is caused to gradually vary in the constant acceleration section. Then, on the basis of the calculated jerk component, the second-order trajectory data generation section generates the second-order trajectory data such that the acceleration varies in a section corresponding to the constant acceleration section in the first-order trajectory data. Namely, by the second-order trajectory data generation section calculating the jerk component such that the acceleration is caused to gradually vary in the constant acceleration section (similar to the constant acceleration section in the prior art control) and then generating the second-order trajectory data such that the acceleration varies in a section corresponding to the constant acceleration section in the first-order trajectory data, the present invention allows the acceleration of the key to vary continuously over time (i.e., in accordance with the passage of time). Thus, the present invention can provide data of a curved trajectory that permit smoother variation of the movement (displacement), velocity and acceleration of the key, thereby achieving smoother reproduction of the key movement or operation. As a result, the present invention can express subtle nuances, soft tone colors, etc. of a performance and thereby enrich the expression of the performance. Note that the term "jerk" is used herein to mean a variation amount, per unit time, of the acceleration (i.e., time differentiation of the acceleration).

In one embodiment, the first-order trajectory data generation section calculates a constant-velocity key depressing trajectory for depressing the particular key at a constant velocity and a constant-velocity key releasing trajectory for releasing the particular key at a constant velocity, then sets, as a constant acceleration section, a given section including an intersection between the constant-velocity key depressing trajectory and the constant-velocity key releasing trajectory to thereby calculate a constant acceleration trajectory where a transition occurs from a key depression phase to a key release phase, and then generates the first-order trajectory data by combining the constant-velocity key depressing trajectory, the constant-velocity key releasing trajectory and the constant acceleration trajectory. Then, the second-order trajectory data generation section sets the jerk component to take a given value in the constant acceleration section, then modifies an acceleration trajectory in the constant acceleration section so that the acceleration gradually vary in accordance with the given value of the jerk component, and then generates the second-order trajectory data by modifying the first-order trajectory data in accordance with the modification of the acceleration trajectory. With such arrangements, the present invention permits continuous variation of the acceleration, without performing constant acceleration (or deceleration) control in a specific section (i.e., acceleration section) where a transition occurs from the key release phase to the key depression phase or from the key depression phase to the key release phase, thereby allowing the key to operate more smoothly in the acceleration section. Such arrangements of the invention are extremely advantageous in that they can significantly enhance the automatic piano's capability for reproducing a successive key depression, particularly a successive key depression based on a so-called half-stroke performance. Namely, the present invention can impart the key with smooth dynamic variation throughout the entire successive-key-depression representing trajectory, so that it can achieve smoother reproduction of the key operation. Therefore, the present invention can effectively eliminate the prior art problems, such as an increase in the string striking intensity and failure or undesired omission or skipping of string striking operation during a successive key depression. Further, the trajectory of the invention for continuously varying the acceleration of the key can increase the trajectory amplitude as compared to the shortcut-trajectory-based successive key depression trajectory disclosed in the No. HEI-9-81125 publication, thereby minimizing undesired key depression errors during a successive key depression performance.

The present invention may be constructed and implemented not only as the apparatus invention as discussed above but also as a method invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION OF THE INVENTION

Figure 1:
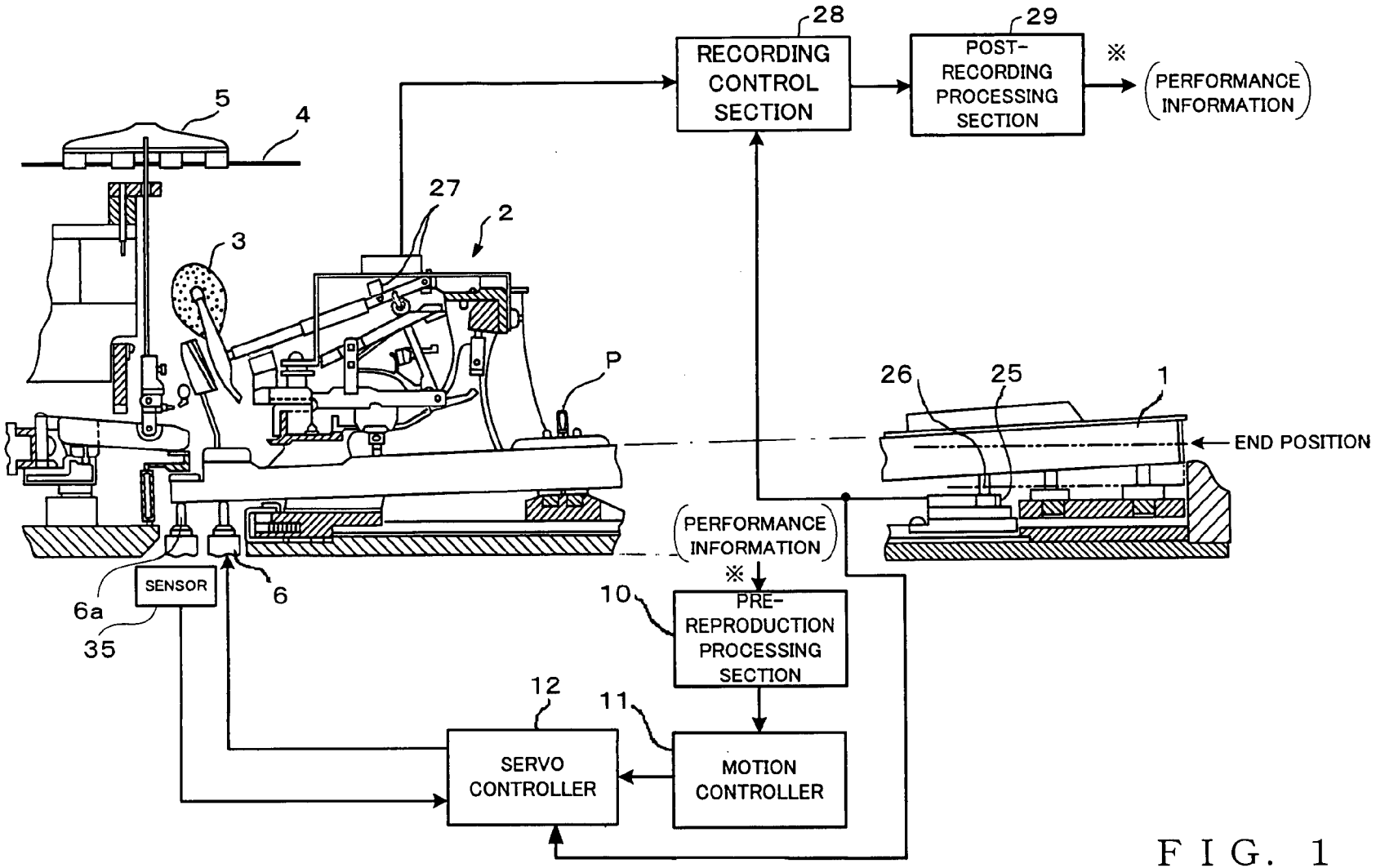
FIG. 1 is a block diagram showing an example general structure of an automatic piano in accordance with an embodiment of the present invention.

FIG. 1 is a block diagram showing an example general structure of an automatic piano in accordance with an embodiment of the present invention, which particularly shows principal portions of a mechanical tone generation mechanism and functional blocks of an electric control system. As illustrated in FIG. 1, the automatic piano includes, as the mechanical tone generation mechanism, a plurality of (e.g., 88) keys 1, an action mechanism 2 for transmitting movement of the keys 1 to corresponding hammers 3 that strike corresponding strings 4 in response to the movement of the keys 1, and dampers 5 for damping vibration of the strings 4. On the underside of a rear end portion of each of the keys 1, there is provided an electromagnetic solenoid 6 as a key drive device for driving the key 1. The key 1 is supported for vertical pivotal movement substantially about its position that has a balance pin P extending therethrough to function as a supporting point. The key 1 when not depressed (when no external force is applied thereto) lies in a rest position as indicated in solid lines in the figure. Once the solenoid 6 is driven (energized), a plunger 6*a* of the solenoid 6 pushes up a rear end portion of the key 1 to cause the key 1 to pivot about the balance pin P so that a front end portion of the key 1 lowers; in this way, depression operation of the key 1 is performed. As the plunger lowers in response to deenergization of the solenoid 6, the key 1 returns to the rest position (key release operation). Basically, each of the keys 1 moves vertically between the rest position and an end position (i.e., position indicated by an imaginary, or two-dots-dash, line in FIG. 1) in response to performance operation (depression an release operation). In response to the depression operation, the action mechanism 2 is activated so that the damper 5 moves away from the string 4 to remove suppression of vibration of the string 4 and also the hammer 3 pivots to strike the string 4, Under each of the keys 1 of the automatic piano, there is provided a key sensor 25 for detecting the movement of the corresponding key 1. The key sensor 25 may be, for example, in the form of an optical position sensor capable of outputting continuous position information of the key 1 throughout a movement stroke of the key 1. For example, there is provided, under each of the keys 1, a detection member 26 that is horizontally opposed to the key sensor 25 to cooperate with the key sensor 25. As the key 1 moves along its stroke path, a position of the detection member 26 relative to the key sensor 25 changes, which is detected as a stroke position of the key 1 so that the key sensor 25 outputs an analog signal representative of a current position of the key 1. As well known in the art, a velocity of the key 1 can be calculated by differentiating the position information; thus, velocity information of the key 1 can be acquired from the output from the key sensor 25. The output from the key sensor 25 is supplied to both of a recording control section 28 and servo controller 12 to be later described, so that it is used in a performance information generation/recording process during recording of a performance and in servo control during performance information reproduction. The optical position sensor employed as the key sensor 25 may be of the conventionally-known construction. In an alternative, the key sensor 25 may be a position sensor of any other suitable type than the optical type.

Further, in the instant embodiment of the automatic piano, there may be provided a hammer sensor 27 for detecting movement of a corresponding one of the hammers 3, and such a hammer sensor 27 may be constructed in generally the same manner to the key sensor 25. In the illustrated example of FIG. 1, the output of the hammer 27 is supplied to the recording control section 28 so that it is used in the performance information generation process during recording of a performance.

For the solenoid 6, there is provided a plunger sensor 35 to detect movement of the plunger 6*a*. In the illustrated example of FIG. 1, the plunger sensor 35 is in the form of a suitable velocity sensor, such as a moving-magnet type velocity sensor, for detecting a moving velocity of the plunger 6*a*, which outputs an analog signal corresponding to a moving velocity of the plunger 6*a* while the solenoid 6 is driven. The output of the plunger sensor 35 is supplied to the servo controller 12 for use in servo control during reproduction of performance information as will be later detailed. Construction of the moving-magnet type velocity sensor, which can be used as the plunger sensor 35, is well known per se, and thus description thereof is omitted here. The plunger sensor 35 may be implemented by any other suitable velocity sensor than the moving-magnet type velocity sensor.

Figure 2:
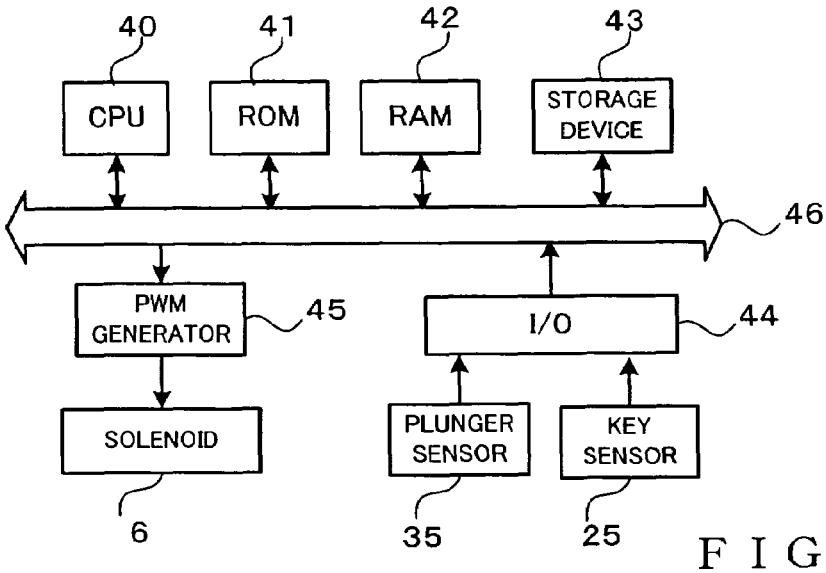
FIG. 2 is a block diagram showing an electric hardware setup of the embodiment of the automatic piano shown in FIG. 1.

Now, an electric hardware setup of the automatic piano of the present invention will be described with reference to FIG. 2. As shown, the automatic piano of the present invention includes a CPU 40, a ROM 41, a RAM 42 and a storage device 43, which are interconnected via a data and address bus 46.

The CPU 40 controls operation of the entire automatic piano and performs various other signal processing, such as the performance information reproduction process and performance information recording (performance recording) process responsive to operation of the keys. Control programs for the various processing to be performed by the CPU 40 may be stored, for example, in the ROM 41. Various data and parameters generated during execution of the various processing are stored in a suitable memory, such as the RAM 42 or ROM 41.

The storage device 43 is used to write therein performance information generated through the performance recording process and store performance information to be used during reproduction of performance information. The storage device 43 may be implemented by a suitable recording medium, such as a hard disk, flexible disk or floppy (trademark) disk, compact disk (CD-ROM), magneto-optical disk (MO), ZIP disk, DVD (Digital Versatile Disk) or semiconductor memory.

Input/output interface (I/O) 44 includes an A/D converter, and detection signals (analog signals) output from the key sensor 25, hammer sensor 27 and plunger sensor 35 are converted, via the I/O 44, into digital signals and then supplied to the CPU 40. The CPU 40 acquires the output of each of the sensors per predetermined clock timing.

Solenoid drive signal generated by the CPU 40 during reproduction of performance information is converted, via a PWM generator 45, into an electrical current signal of the PWM format (hereinafter referred to as "PWM signal") and then supplied to the solenoid 6. The automatic piano of the present invention may further include a group of setting operators operable by a human operator (user) to select a desired operation mode and the like, a communication interface for connection to external equipment, etc.

Next, a description will be made about the performance recording process and performance information reproduction process carried out in the instant embodiment of the automatic piano. In FIG. 1, the recording control section 28 and post-recording processing section 29 together constitute a module pertaining to the performance recording process, and a pre-reproduction processing section 10, motion controller 11 and servo controller 12 together constitute a module pertaining to the performance information reproduction process. Various operations, such as arithmetic operations, are performed by these modules in accordance with software programs executed by the CPU 40.

The recording control section 28 receives the outputs of the key sensor 25 and hammer sensor 27 for each of the keys 1 and acquires, from physical amount information related to movement of the key 1 and hammer 3 detected by the key sensor 25 and hammer sensor 27, various information, such as a key depression velocity, key release velocity, string striking velocity and respective times of the key depression, string striking and key release events. The post-recording processing section 29 performs normalization operations on the various information acquired by the recording control section 28, and then, on the basis of these various information related to the performance events, generates performance information indicative of the contents of the piano performance. Namely, the post-recording processing section 29 supplies the various performance-event-related information to the storage device 43 (FIG. 2) as performance information. Here, the performance information comprises a combination of a performance event to be reproduced and time data at which the performance event should be generated, and it may be created in a suitable data format, such as the MIDI data format. The "normalization process" is a process intended to absorb an individual specificity of the automatic piano. Specifically, the various physical information of the automatic piano has unique or peculiar tendencies, due to sensor positions in the piano, structure, mechanical errors, etc. differing from those of other automatic pianos, the normalization process appropriately converts the key depression time and velocity, key release time and velocity, string striking time and velocity, etc. on the basis of an assumed standard piano.

On the basis of performance information supplied from the storage device 43 (see FIG. 2), real-time communication device (not shown) or the like, the pre-reproduction processing section 10 generates trajectory data of each key to reproduce a performance event represented by the performance information. The generated trajectory data are supplied to the motion controller 11. The motion controller 11 uses the supplied trajectory data to generate a control signal (target value) for controlling driving of the solenoid 6, and supplies the generated control signal (target value) to the servo controller 12. The servo controller 12 performs servo control on the basis of the target value and feedback signals; in this case, the outputs of the key sensor 25 and plunger sensor 35 are used as the feedback signals. Through the servo control performed by the servo controller 12, the solenoid 6 controls the energizing current (solenoid drive signal) to be supplied to the solenoid 6. In this way, the key 1 is driven in accordance with the supplied trajectory data.

The following paragraphs describe an example operational sequence of a trajectory data creation process carried out in the pre-reproduction processing section 10. Here, the term "trajectory" means positional variation over time of a key.

Japanese Patent Application Laid-open Publication No. HEI-7-175472 mentioned above discloses an example of the conventionally-known trajectory creation principle. According to the disclosed trajectory creating principle, information of a velocity (reference velocity) which the key should assume at a predetermined point (reference point) on a key trajectory and a time (reference time) at which the key 1 should pass the reference point are calculated as fundamental parameters for creating trajectory data on the basis of performance information to be reproduced. Also, trajectory data of a desired trajectory type passing the reference point is created. Here, the "reference point" is a predetermined stroke position of the key 1 that can be set in advance through an experiment or otherwise. The "reference velocity" and "reference time" can be calculated on the basis of the performance information to be reproduced. Details of arithmetic operations for calculating the reference velocity and reference time are discussed in the above-mentioned No. HEI-7-175472 publication, and the instant embodiment of the invention may also employ arithmetic operations similar to the disclosed arithmetic operations.

In the instant embodiment of the preset invention, a key depressing (or depressed key) trajectory, along which the key 1 should move, at a constant velocity, from a rest position xR (i.e., key position of a zero-mm stroke amount) to an end position xE (i.e., key position 10 mm lower than the rest position xR) is created in accordance with the trajectory creating principle and on the basis of performance information (e.g., string striking velocity, string striking time) corresponding to a key depression event; hereinafter, such a key depressing trajectory will be referred to as "constant-velocity key depressing trajectory". Also, a key releasing (or released key) trajectory, along which the key 1 should move, at a constant velocity, from the end position xE back to the rest position xR, is created in accordance with the trajectory creating principle and on the basis of performance information (e.g., key release velocity and key release time) corresponding to a key release event; hereinafter, such a key releasing trajectory will be referred to as "constant-velocity key releasing trajectory". Note that the rest position xR (i.e., key position of a zero-mm stroke amount) and end position xE (i.e., key position 10 mm lower than the rest position xR) are set in advance as fixed values.

Because it is assumed here that the key moves at a constant velocity along the constant-velocity key depressing trajectory, an initial key velocity at the time of the key depression operation is equal to the above-mentioned reference velocity, and thus the initial key velocity can be set as a known value. If the initial key velocity at the time of the key depression operation (=reference velocity) is represented as a reference key depression velocity "vP" (vP>0), time elapsed from a start point of driving of the key is represented by "t" and a position of the key along the trajectory is represented by "X", then the constant-velocity key depressing trajectory can be expressed by the following mathematical expression:

$$X=vP*t+xR \qquad \text{Mathematical Expression (1)}$$

In this specification, "*" represents a multiplication.

By mathematical expression (1) above, it is possible to determine a key depression start time (i.e., "key depression rest departing time" tPR) and key depression end time (i.e., "key depression end arriving time" tPE) when predetermined performance information should be reproduced in accordance with a linear trajectory. Then, control can be performed, in accordance with the trajectory data, such that the key 1 is driven to move from the key depression rest departing time tPR at the constant velocity vP.

Trajectory to be followed by a key 1 in response to release operation of the key 1 ("constant-velocity key releasing trajectory") can also be determined by defining a predetermined reference point (e.g., position of the key 1 when the damper 5 contacts the corresponding string 4), reference velocity (reference key release velocity vN) and reference time and then setting a linear trajectory based on performance information. Because the constant-velocity key releasing trajectory in this case assumes that the key 1 moves at a constant velocity, an initial key velocity at the time of the key release operation equals the reference key release velocity vN (vN<0). Therefore, if a time elapsed from the start point of driving of the key is represented by "tN" and a position of the key along the constant-velocity key releasing trajectory is represented by "XN", then the constant-velocity key releasing trajectory can be expressed by the following mathematical expression:

$$XN=vN*tN+xE \qquad \text{Mathematical Expression (2)}$$

By mathematical expression (2) above, it is possible to determine a key release start time (i.e., "key release end departure time" tNE) and key release end time (i.e., "key release rest arrival time" tNR) when performance information (key release event) should be reproduced along a linear trajectory. Then, control can be performed such that the key 1 is released from the key release end departing time tNE at the constant velocity vN.

With the constant-velocity key depressing trajectory and constant-velocity key releasing trajectory obtained in the above-described manner, it is possible to reproduce, at a constant velocity, movement of the key that is first depressed from the rest position to the end position and then returned from the end position to the rest position. However, in an actual piano performance, there is employed, in addition to such constant-speed movement trajectories of keys, performance styles involving variation in the moving velocity of a key, such as one where the moving velocity of a key varies during the course of depression of the key and one where release operation of a current key (or depression operation of a next key) is started before the current key is completely depressed to the end position (or before the current key is completely returned to the rest position) as in a so-called half-stroke performance. However, with constant velocity trajectories as described above, it is impossible to appropriately reproduce a trajectory of a key involving variation in the moving velocity. Further, in a half-stroke successive key depression etc., a key in question tends to get out of control, so that accurate performance reproduction is difficult to achieve. The instant embodiment of the automatic piano is characterized in that improvements have been made to the above-mentioned points in connection with the trajectory creation. Namely, the instant embodiment is characterized in that a smooth curved trajectory is created, as necessary, to permit continuous variation in the moving velocity and acceleration of a key and that driving of the key is controlled on the basis of the thus-created smooth curved trajectory.

Next, a description will be given about a process for creating such a curved trajectory in the instant embodiment. Specifically, a description will be made about a case where a trajectory representative of a half-stroke successive key depression where a key having been depressed to the end position is again depressed to the end position before the key is completely returned to the rest position (namely, a half-stroke successive key depression where key release operation and key depression operation is repeated with the key depressed halfway).

Figure 3:
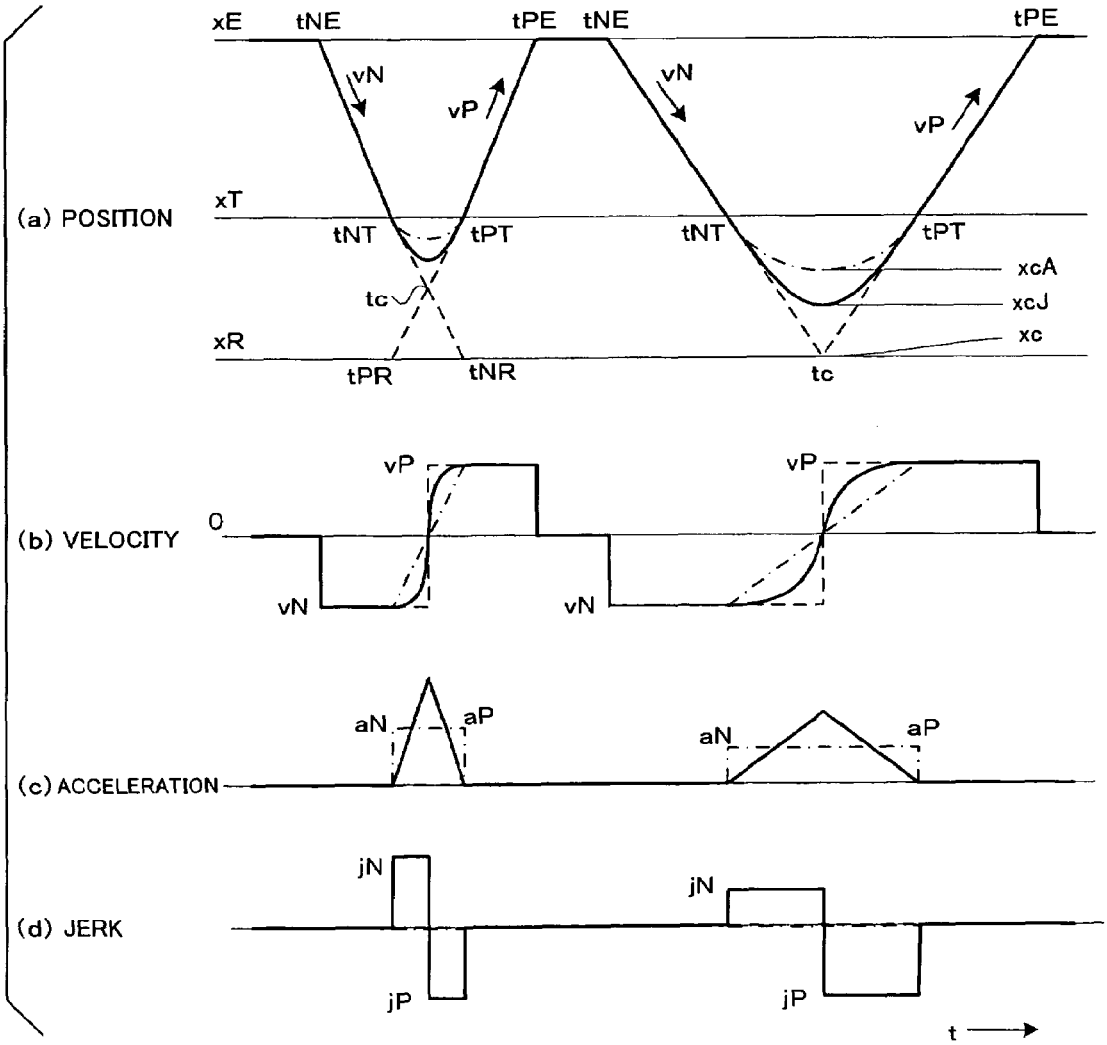
FIG. 3 is a trajectory diagram showing an example trajectory representative of a successive depression of a key in the embodiment of the automatic piano, where section (a) shows a position component of the successive key depression trajectory, section (b) shows a velocity component of the successive key depression trajectory, section (c) shows an acceleration component of the trajectory and section (d) shows a jerk component of the trajectory.

Section (a) of FIG. 3 is a trajectory diagram showing an example trajectory representative of a successive depression of a key (i.e., successive key depression trajectory) created and employed in the instant embodiment. In section (a) of FIG. 3, a solid line indicates a successive key depression trajectory (i.e., variation over time of a position component), and a broken line indicates a trajectory based on constant velocity movement of the key (constant velocity trajectory). Further, section (b) of FIG. 3 indicates variation of a velocity component in the trajectory of section (a) above, section (c) indicates variation in an acceleration component in the trajectory of section (a), and section (d) indicates variation in a jerk component in the trajectory of section (a), Here, the term "jerk" means a variation amount, per unit time, of the acceleration (i.e., time differentiation of the acceleration). Furthermore, in each of sections (b), (c) and (d) of FIG. 3, solid lines indicate variation in the various components in the successive key depression trajectory, and broken lines indicate variation of the above-mentioned various components in the constant velocity movement.

As indicated by the solid line of section (a) of FIG. 3, the continuous trajectory, indicative of key release and key depression operation, is represented, in a section thereof from the end position xE to a predetermined stroke position, by a constant-velocity key depressing trajectory and constant-velocity key releasing trajectory as described above, and represented, in a section thereof where a transition occurs from the key release operation (key release phase) to the key depression operation (key depression phase), represented by a trajectory of a third-order curve. Namely, the continuous successive key depression trajectory illustrated in section (a) of FIG. 3 comprises a combination of the constant velocity trajectory and third-order-curve trajectory. The "predetermined stroke position" mentioned above may be set, as appropriate, between the end position xE and the rest position xR so as to permit smooth, natural movement of the key 1; in the following description, this predetermined stroke position is referred to as "transit position xT". Because the reproducibility of the key velocity would become unstable if the constant velocity trajectory is too short, it is preferable that the above-mentioned transit position xT be set closer to the rest position xR than the midpoint between the end position xE and the rest position xR. Also, in the following description, a time at which the key passes the transit position xT during the release operation (phase) is referred to as "key release transit position passage time tNT", and similarly a time at which the key passes the transit position xT during the depression phase is referred to as "key depression transit position passage time tPT".

More specifically, a portion from the end position xE to the transit position xT in the key release phase section of the continuous successive key depression trajectory, illustrated in section (a) of FIG. 3, is represented (expressed) by the constant-velocity key releasing trajectory, and a portion from the transit position xT to a key release operation end point in the key release phase section is represented by a curved trajectory indicative of a gradually-varying key velocity characteristic (hereinafter, this curved trajectory will be referred to as "key release slow-down trajectory"). Further, a portion from a key depression start point to the transit position xT in the key depression phase section of the continuous successive key depression trajectory is represented by a curved trajectory indicative of a gradually-varying key velocity characteristic (hereinafter, this curved trajectory will be referred to as "key depression slow-up trajectory"), and a portion from the transit position xT to the end position xE is represented by the constant-velocity key depressing trajectory.

First, according to an example operational sequence of the successive key depression trajectory creation process, constant-velocity key releasing and key depressing trajectories are calculated on the basis of the performance information, and then a determination is made as to whether the calculated constant-velocity key releasing and key depressing trajectories intersect with each other, to check whether there is a need to create a curved trajectory. If there is such a need to create a curved trajectory, the curved trajectory is created through arithmetical operations to be later described. Here, "constant-velocity key releasing and key depressing trajectories intersect with each other" means that these two trajectories intersect with each other before they reach the rest position xR as depicted in dotted lines in section (a) of FIG. 3; in such a case, the key trajectories reproduced by the constant-velocity key releasing trajectory and key depressing trajectory represents a half-stroke performance in which key depression operation is started before the key is completely returned to the rest position. The determination as to whether the constant-velocity key releasing and key depressing trajectories intersect with each other may be made using various conditions and schemes, e.g. using any of the conventionally-known conditions and schemes. As an example, it can be determined that the constant-velocity key releasing and key depressing trajectories intersect with each other, if the time at which the constant-velocity key releasing trajectory reaches the rest position xR (i.e., key release rest arrival time tNR) is later than the start time of the constant-velocity key depressing trajectory (key depression rest departing time tPR). Specific examples of various conditions for determining the intersection between the constant-velocity key releasing trajectory and key depressing trajectory are described, for example, in the above-discussed No. HEI-9-81125 publication, and thus a detailed description of the conditions is omitted here. Where the constant-velocity key releasing and key depressing trajectories do not intersect with each other before reaching the rest position xR, a half-stroke performance trajectory may sometimes be expressed by a combination of the constant-velocity key releasing trajectory and key depressing trajectory with a curved trajectory. Thus, in the case where the constant-velocity key releasing and key depressing trajectories do not intersect with each other before reaching the rest position xR, it may be further ascertained, through arithmetic operations, whether a key release slow-down trajectory and key depression slow-up trajectory intersect with each other. Determining arrangements to be employed in such a situation are also described in detail in the No. HEI-9-81125 publication.

Although it is assumed here, for convenience of description, that the instant embodiment makes a determination as to whether or not there is a need to create a curved trajectory (i.e., key release slow-down trajectory and key depression slow-up trajectory), depending only on the result of the determination as to whether the constant-velocity key releasing trajectory and key depressing trajectory intersect with each other, the further determination as to whether the key release slow-down trajectory and key depression slow-up trajectory intersect with each other, independently of the result of the determination as to whether the constant-velocity key releasing trajectory and key depressing trajectory intersect with each other. Furthermore, the performance information may include marker data indicating that a curved trajectory should be created in the performance event in question. In short, it is only necessary that a curved trajectory (i.e., key release slow-down trajectory and key depression slow-up trajectory) be created when the key is to be driven with an acceleration characteristic.

In the case where it has been determined that the constant-velocity key releasing trajectory and key depressing trajectory intersect with each other, a process is carried out for creating a curved trajectory (i.e., key release slow-down trajectory and key depression slow-up trajectory). Position and time at which the constant-velocity key releasing trajectory and key depressing trajectory intersect with each other are referred to as a constant velocity trajectory intersecting position xc and constant velocity trajectory intersecting time tc, respectively. The constant velocity trajectory intersecting time tc can be determined through arithmetic operations using data of the constant-velocity key releasing trajectory and key depressing trajectory. Namely, the constant velocity trajectory intersecting time tc can be calculated by the following mathematical expression:

$$tc=(-vN*tNE+vP*tPE)/(-vN+vP) \quad \text{Mathematical Expression (3)}$$

Note that, in the calculation of the constant-velocity-trajectory intersecting time tc based on mathematical expression (3) above, the reference key release velocity vN (<0), key release end departure time tNE, reference key depression velocity vP (>0) and key depression end arrival time tPE are each determined as a known value.

Because the constant velocity trajectory intersecting time tc is a time point when the key release operation shifts to the key depression operation, the key release slow-down trajectory is set such that the key velocity gradually decreases from the value vN to zero within a time period from the key release transit position passage time tNT to the trajectory intersecting time tc, while the key depression slow-up trajectory is set such that the key velocity gradually increases from zero to the value vP within a time period from the trajectory intersecting time tc to the key depression transit position passage time tPT. Time period from the key release transit position passage time tNT to the key depression transit position passage time tPT is when the curved trajectory (i.e., key release slow-down trajectory and key depression slow-up trajectory) is to be applied.

First, key release acceleration aN in the key release slow-down trajectory is determined. Because the acceleration is a time differentiation of the velocity, the key release acceleration aN can be calculated by the following mathematical expression:

$$aN=(0-vN)/(tc-tNT) \quad \text{Mathematical Expression (4)}$$

The key release transit position passage time tNT in mathematical expression (4) above can be calculated by $$tNT=tNE+(xT-xE)/vN \quad \text{Mathematical Expression (5)}$$

Note that the transit position xT and end position xE in mathematical expression (5) above are set in advance as fixed values.

Further, key depression acceleration aP in the key depression slow-up trajectory can be calculated by the following mathematical expression:

$$aP=(vP-0)/(tPT-tc) \quad \text{Mathematical Expression (6)}$$

The key depression transit position passage time tPT in mathematical expression (6) above can be calculated by $$tPT=tPE-(xE-xT)/vP \quad \text{Mathematical Expression (7)}$$

By determining the key release acceleration aN and key depression acceleration aP, it is possible to generate a key release slow-down trajectory (i.e., trajectory of a time-varying key release velocity characteristic) and key depression slow-up trajectory (i.e., trajectory of a time-varying key depression velocity characteristic), as indicated by one-dot-dash lines in section (a) of FIG. 3. Namely, on the basis of the key release acceleration aN and key depression acceleration aP, key depression and key release velocity information, continuously varying over time, can be determined, and also trajectory data of a curved trajectory for reproducing the continuous velocity variation (i.e., key release slow-down trajectory and key depression slow-up trajectory indicated by one-dot-dash lines) can be calculated. This trajectory is a constant velocity trajectory kept at predetermined values of the acceleration component (i.e., key release acceleration aN and key depression acceleration aP) as indicated by one-dot-dash lines in section (c) of FIG. 3. In section (b) of FIG. 3, there is shown a manner in which the velocity component varies continuously in the constant acceleration trajectory. Technique for creating such a trajectory to cause a key velocity to continuously vary while keeping acceleration at a constant value is disclosed in the above-mentioned No. HEI-9-81125 publication.

Data of the overall trajectory composed of the position, velocity and acceleration components, determined through the above-described operations for automatic operation of the key in question, will hereinafter be referred to as "first-order trajectory data". The first-order trajectory data are data that can be determined in the conventionally-known manner and have a constant acceleration characteristic.

Next, the first-order trajectory data are modified so as to set up the key release slow-down trajectory and key depression slow-up trajectory proposed in accordance with the present invention and to cause the acceleration component (i.e., key release acceleration and key depression acceleration) to vary over time. Thus, in order to calculate, from the first-order trajectory data, such acceleration information that varies continuously, a jerk component which represents variation amounts per unit time (i.e., time-differentiated values) of the time-varying key release acceleration and key depression acceleration.

Key release jerk jN in the key release slow-down trajectory can be calculated by the following mathematical expression:

$$jN=2*aN/(tc-tNT) \quad \text{mathematical expression (8),}$$

where aN represents key release acceleration in the above-mentioned constant acceleration trajectory. Namely, mathematical expression (8) above is intended to calculate, as the key release jerk jN, such an acceleration variation value per unit time that makes an acceleration variation amount, in a section of a time length "tc−tNT", twice as great as the key release acceleration aN. Note that the coefficient "2" may be variably adjusted as appropriate.

Key depression jerk jP in the key depression slow-up trajectory can be calculated by the following mathematical expression:

$$jP=2*aP/(tPT-tc) \quad \text{Mathematical Expression (9),}$$

where aP represents key depression acceleration in the above-mentioned constant acceleration trajectory. The meaning of mathematical expression (9) is similar to that of mathematical expression (8) above.

By determining the key release jerk jN and key depression jerk jP with mathematical expressions (8) and (9) above, it is possible to generate the key release slow-down trajectory and key depression slow-up trajectory as indicated by solid lines in section (a) of FIG. 3. Namely, in this way, the trajectory in the constant velocity section of the first-order trajectory data (i.e., constant acceleration trajectory indicated by one-dot-dash lines) is replaced, or modified, with the key release slow-down trajectory and key depression slow-up trajectory as indicated by solid lines in section (a) of FIG. 3; the thus-modified data will hereinafter be referred to as "second-order trajectory data". With the thus-generated key release slow-down trajectory and key depression slow-up trajectory ("second-order trajectory data"), the jerk component in the overall trajectory can be kept at given constant values (key release jerk jN and key depression jerk jP) in a predetermined section of the trajectory data (i.e., time period from the key release transit position passage time tNT to the key depression transit position passage time tPT) which includes an intersecting time tcJ of the key release slow-down trajectory and key depression slow-up trajectory (=constant velocity trajectory intersecting time tc), as indicated by solid lines in section (d) of FIG. 3; such trajectories will be referred to as "constant jerk trajectories". By controlling the jerk component to be kept at constant values on the basis of the calculated key release jerk jN and key depression jerk jP, it is possible to continuously vary the key depression acceleration and key release acceleration over time as indicated by solid lines in section (c) of FIG. 3. By thus continuously varying the acceleration in accordance with the constant jerk trajectories, the velocity component can be varied to assume a curved characteristic, as indicated by solid lines in section (b) of FIG. 3. Therefore, with the constant-jerk-based key release slow-down trajectory and key depression slow-up trajectory proposed in accordance with the present invention, the movement (displacement), velocity and acceleration of the can be controlled smoothly as compared to the conventional constant velocity and constant acceleration trajectories. Further, the acceleration variation in the start position of the key release slow-down trajectory (key release transit position) can be significantly smoothed as compared to that in the conventional constant acceleration trajectory, so that the instant embodiment can effectively prevent the key from undesirably getting out of control during the key release operation.

In section (a) of FIG. 3, the intersecting position xc between the constant-jerk-based key release slow-down trajectory and constant-jerk-based key depression slow-up trajectory (indicated by solid lines), proposed in accordance with the present invention, is located closer to the rest position xR than an intersecting position xcA between constant-acceleration-based key release slow-down trajectory and key depression slow-up trajectory (one-dot-dash lines). Therefore, the constant-jerk-based key release slow-down trajectory and constant-jerk-based key depression slow-up trajectory, proposed in accordance with the present invention, can significantly increase the driven amplitude of the key than the constant-acceleration-based key release slow-down trajectory and constant-acceleration-based key depression slow-up trajectory. Specifically, the intersecting position xcA based on the constant acceleration (i.e., intersecting position xcA in the first-order trajectory data) is located at a substantial midpoint between the transit position xT and the constant-velocity-based intersecting position xc, whereas the intersecting position xcJ based on the constant jerk (i.e., intersecting position xcJ in the second-order trajectory data) is located at a substantial midpoint between the constant-acceleration-based intersecting position xcA and the constant-velocity-based intersecting position xc. Thus, with the constant-jerk-based trajectory, a distance from the transit position xT to the intersecting position can be increased by a factor of about ⅔ as compared to that provided with the constant-acceleration-based trajectory. By thus increasing the amplitude of the trajectory, it is possible to reduce key striking errors during reproduction of the trajectory data.

Trajectory data are created in the pre-reproduction processing section 10 (see FIG. 1) through the above-described processes. The processes performed in the pre-reproduction processing section 10 for creating the above-mentioned first-order trajectory data and second-order trajectory data are implemented by a computer program for causing the CPU 40 (see FIG. 2) to perform the above-described arithmetic and other operations. In an alternative, these trajectory data creation processes may be implemented by dedicated hardware circuitry. Needless to say, if the curved trajectories (key release slow-down trajectory and key depression slow-up trajectory) are not included in the first-order trajectory data, then the first-order trajectory data may be output directly without being modified.

Then, the motion controller 11 (FIG. 1) generates a control signal (target value) for controlling the solenoid 6, using the created trajectory data (second-order trajectory data, or first-order trajectory data if the second-order trajectory data have not been created), and supplies the generated control signal (target value) to the servo controller 12. In turn, the servo controller 12 performs servo control based on the supplied control signal and respective outputs of the key sensor 25 and plunger sensor 35.

Figure 4:
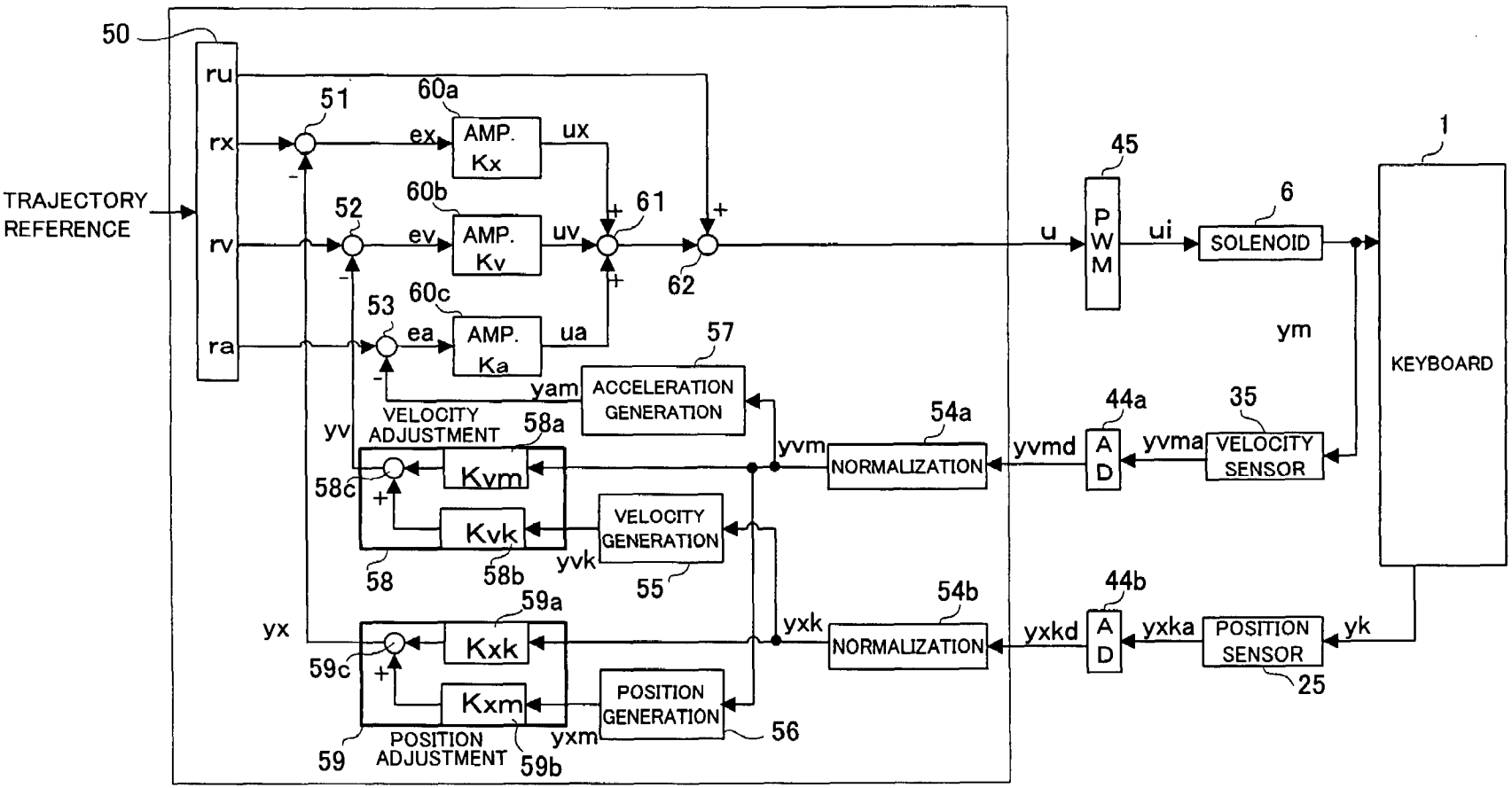
FIG. 4 is a functional block diagram showing an example structure of a servo control system employed in the embodiment of the automatic piano.

FIG. 4 is a block diagram functionally showing an example of a servo control system employed in the automatic piano of the present invention. In FIG. 4, various arithmetic operations taking place in a feedback loop, represented by a one-dot-dash line block, are implemented by a software program executed by the CPU 40 (see FIG. 2).

Target value generation section 50 is supplied with trajectory data (trajectory reference) of a key generated in accordance with performance information to be reproduced, as a target value (reference value) of the servo control. In accordance with the supplied trajectory reference, the target value generation section 50 generates, as target values at a given time, position target value rx, velocity target value rv and acceleration target value ra. Here, the position target value rx, velocity target value rv and acceleration target value ra are position, velocity and acceleration components, respectively, in the trajectory data. The respective target values of the position, velocity and acceleration, generated by the target value generation section 50, are output in parallel per predetermined sampling time (e.g., every one ms). In the figure, "ru" represents a direct output of an electric amount (electric current signal) corresponding to the target values. Let it be assumed here that a usage rate of the current signal ru to the target values is determined empirically. The respective target values of the position, velocity and acceleration, generated by the target value generation section 50, are supplied to a position comparator section 51, velocity comparator section 52 and acceleration comparator section 53, respectively, in accordance with the above-mentioned sampling time.

Explaining now taking-in of the outputs of the key sensor 25 and plunger sensor 35, once the solenoid 6 is turned on, the key 1 corresponding to the turned-on solenoid 6 is driven. The velocity sensor (plunger sensor) 35 detects a moving velocity ym of the plunger of the solenoid 6, and it outputs an analog detection signal yvma corresponding to the detected moving velocity ym. A/D converter 44*a* (corresponding to the I/O 44 of FIG. 2) converts the analog signal yvma representative of the plunger velocity, output from the velocity sensor (plunger sensor) 35, into a digital signal (plunger velocity detection value) yvmd.

Further, the position sensor (key sensor) 25 detects a stroke position of the key 1 driven by the solenoid 6 and outputs an analog detection signal yxka corresponding to the detected stroke position yk of the key 1. A/D converter 44*b* (corresponding to the I/O 44 of FIG. 2) converts the analog detection signal yxka, output from the position sensor (key sensor) 25, into a digital signal (key position detection value) yxkd.

The digital plunger velocity detection value yvmd and key position detection value yxkd, output from the A/D converters 44*a* and 44*b*, are supplied to normalization processing sections 54*a* and 54*b*, respectively, where predetermined normalization processes are performed on the plunger velocity detection value yvmd and key position detection value yxkd. In FIG. 4, the plunger velocity detection value and key position detection value having been subjected to the normalization processes are indicated by "yvm" and "yxk", respectively.

Velocity generation section 55 generates velocity information of the key 1 (key velocity value yvk) on the basis of the key position detection value yxk. Specifically, the velocity generation section 55 calculates the key velocity information (key velocity value yvk) by performing an appropriate differentiation operation (e.g., polynomial adaptation) on the position information of the key 1 output from the key sensor 25; as an example, the key velocity information (key velocity value yvk) can be calculated by secondary curve adaptation using key position information(key position detection values) at a total of seven points consisting of a given sampling point and three sampling points before and after the reference time point.

Position generation section 56 generates position information of the plunger 6*a* (plunger position detection value yxm) on the basis of the plunger velocity detection value yvk. Specifically, the position generation section 56 calculates the plunger position information (plunger position value yxm) by performing an integration operation on the plunger velocity information output from the plunger sensor 35.

Acceleration generation section 57 generates acceleration information of the plunger 6*a* (plunger acceleration value yam) on the basis of the plunger velocity detection value yvm. Specifically, the acceleration generation section 57 calculates the plunger acceleration information by performing an appropriate differentiation operation (e.g., polynomial adaptation) on the velocity information of the plunger 6*a* output from the plunger sensor 35; as an example, the plunger acceleration information (plunger acceleration detection value yam) can be calculated by secondary curve adaptation using plunger velocity information (plunger velocity detection value yvm) at a total of seven points consisting of a given sampling point and three sampling points before and after the reference time point.

Velocity adjustment section 58 is supplied with the plunger velocity detection value yvm output from the plunger sensor 35 and the key velocity value yvk generated by the velocity generation section 55. The velocity adjustment section 58 selects either the plunger velocity detection value yvm or the key velocity value yvk, to thereby provide a velocity feedback signal yv that is feedback-controlling velocity information based on the outputs of both the plunger sensor 35 and the key sensor 25. The velocity feedback signal yv is fed back (negative feedback) to the velocity comparator section 52 for comparison with the velocity target value rv generated by the target value generation section 50.

Specifically, in the velocity adjustment section 58, the plunger velocity detection value yvm is weighted with a predetermined coefficient Kvm via an arithmetic operation element 58*a*, the key velocity value yvk is weighted with a predetermined coefficient Kvk via an arithmetic operation element 58*b*, and then an addition element 58*c* adds together the thus weighted values to thereby provide the velocity feedback signal yv. Here, the coefficients Kvm and Kvk for the plunger velocity detection value yvm and key velocity value yvk are set to appropriate values, on the basis of some experimental results, depending on which of the values yvm and yvk the velocity feedback signal yv should emphasize while maintaining relationship of "Kvm+Kvk=1". As examples of the coefficients Kvm and Kvk based on the experimental results, the coefficient Kvm may be set to 0.7, while the coefficient Kvk may be set to 0.3.

Position adjustment section 59 is supplied with the key position detection value yxk output from the key sensor 25 and the plunger position value yxm generated by the position generation section 56. The position adjustment section 59 adjusts the key position detection value yxk and the plunger position value yxm into a position feedback signal yx that is feedback-controlling position information based on the outputs of both the key sensor 25 and the plunger sensor 35. The position feedback signal yx is fed back (negative feedback) to the position comparator section 51 for comparison with the position target value rx generated by the above-mentioned target value generation section 50.

Specifically, in the position adjustment section 59, the key position detection value yxk is weighted with a predetermined coefficient Kxk via an arithmetic operation element 59*a*, the plunger position value yxm is weighted with a predetermined coefficient Kxm via an arithmetic operation element 59*b*, and then an addition element 59*c* adds together the thus weighted values to thereby provide the position feedback signal yx. Here, the coefficients Kxk and Kxm are set to appropriate values, on the basis of some experimental results, depending on which of the key position value yxk and plunger position value yxm the position feedback signal yx should emphasize while maintaining relationship of "Kxk+Kxm=1". As examples of the coefficients Kxk and Kxm based on the experimental results, the coefficient Kxk may be set to 0.9, while the coefficient Kxm may be set to 0.1.

The plunger acceleration value yam calculated by the acceleration generation section 57 is fed back (negative feedback) to the acceleration comparator section 53 for comparison with a target acceleration value ra generated by the target value generation section 50. As one example, the key velocity value yvk calculated by the velocity generation section 55 may be further differentiated to obtain key acceleration information, and then the thus-obtained key acceleration information and plunger acceleration value yam may be adjusted into a single position feedback signal. In such a case, however, the key acceleration information will undesirably undergone signal quality deterioration because it is a value obtained through second-order differentiation of the key position value yxk; therefore, the instant embodiment does not employ such an approach.

In the above-described manner, feedback-controlling physical amount information, i.e. position feedback signal yx, velocity feedback signal yv and plunger acceleration value yam, corresponding to the target position, velocity and acceleration values are given on the basis of the outputs of the key sensor 25 and plunger sensor 35.

The position comparator section 51 is supplied with the position feedback signal yx output from the position adjustment section 59 and the target position value rx output from the target value generation section 50. Then, the position comparator section 51 performs a subtractive operation between the target position value rx and the value of the position feedback signal yx to calculate a position offset ex indicative of a difference between the two values rx and yx.

The velocity comparator section 52 is supplied with the velocity feedback signal yv output from the velocity adjustment section 58 and the target velocity value rv output from the target value generation section 50. Then, the velocity comparator section 52 performs a subtractive operation between the target velocity value rv and the value of the velocity feedback signal yv to calculate a velocity offset ev indicative of a difference between the two values rv and yv The acceleration comparator section 53 is supplied with the plunger acceleration value yam output from the acceleration generation section 57 and the target acceleration value ra output from the target value generation section 50. Then, the acceleration comparator section 53 performs a subtractive operation between the target acceleration value ra and the plunger acceleration value yam to calculate an acceleration offset ea indicative of a difference between the two values ra and yam. Because the target acceleration value ra is included as a servo control factor, the instant embodiment of the invention can control the jerk component during the driving of the key in a more direct manner. If a constant jerk trajectory for continuously varying the acceleration as noted above is to be reproduced, the driving of the key will be controlled so that the jerk component is kept at a given constant value.

The position offset ex is amplified by an amplifier 60*a* in accordance with a position servo gain Kx, and the thus-amplified position offset ex is supplied to an addition section 61 as a position control signal ux. The velocity offset ev is amplified by an amplifier 60*b* in accordance with a velocity servo gain Kv, and the thus-amplified velocity offset ev is supplied to the addition section 61 as a velocity control signal uv. Further, the acceleration offset ea is amplified by an amplifier 60*c* in accordance with an acceleration servo gain Ka, and the thus-amplified acceleration offset ea is supplied to the addition section 61 as an acceleration control signal ua. The gains Kx, Kv and Ka to be multiplied with the position offset ex, velocity offset ev and acceleration offset ea, respectively, may be set to appropriate values through experiments. For example, the position servo gain Kx, velocity servo gain Kv and acceleration servo gain Ka may be set to 1.7, 3.5 and 0.5, respectively; with these gain coefficients, the emphasis of the servo control is placed on the velocity component.

The addition section 61 adds together the position control signal ux, velocity control signal uv and acceleration offset ea, to thereby convert the control signals of the three control factors into a single control signal. Then, a solenoid drive signal u is generated by an addition element 62 further adding a target-value-corresponding current signal ru to the result of the addition by the addition section 61.

The solenoid drive signal u is converted via the PWM generator 45 into a solenoid energizing current signal ui of the PWM format, on the basis of which the solenoid 6 is driven.

As described above, the above-described servo control system is constructed to generate the solenoid drive signal u reflecting the movement of the solenoid 6, i.e. a direct object of the servo control, and the movement of the key 1 to be driven by the solenoid 6. By thus driving the solenoid 6 with the solenoid energizing current signal ui corresponding to the solenoid drive signal u, the instant embodiment allows the key 1 to operate more accurately with respect to the target values, so that a given trajectory reference can be reproduced with an increased accuracy and precision. Further, with the servo control system of FIG. 4, it is possible to realize hybrid-type servo control based on the target values of the individual factors, i.e. position, velocity and acceleration, and feedback control signals of the individual events generated on the basis of the outputs of the key sensor 25 for detecting the position of the key 1 and plunger sensor 35 for detecting the velocity of the plunger 6*a*, with the result that an automatic piano of an improved performance can be provided by the present invention. Further, the servo control system of FIG. 4 uses the velocity information generated by differentiating the output of the position sensor (key sensor 25), the position information generated by integrating the output of the velocity sensor (plunger sensor 35), and the acceleration information generated by differentiating the output of the velocity sensor (plunger sensor 35). Thus, if the hybrid-type servo control employed in the instant embodiment is considered from the viewpoint of position control, the velocity servo control performs a function as a derivative compensator. Also, if the hybrid-type servo control is considered from the viewpoint of velocity control, the position servo control performs a function as an integral compensator, and the acceleration servo performs a function as a derivative compensator.

Figure 5:
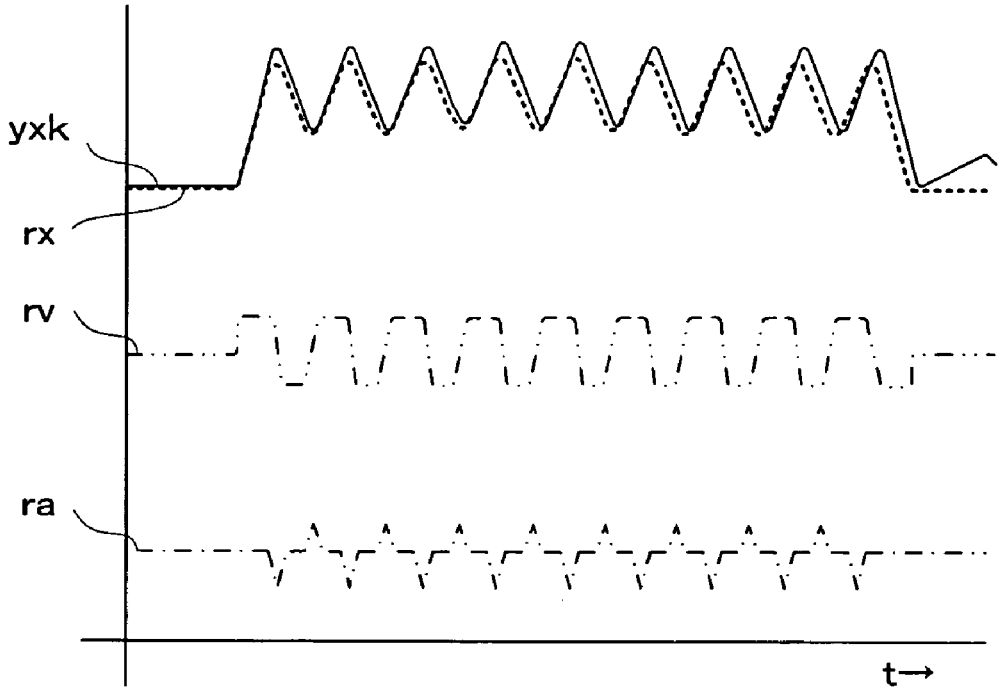
FIG. 5 is a graph showing example actual measurements of control results when driving of a key was controlled in accordance with data of the successive key depression trajectory proposed by the present invention.

FIG. 5 is a graph showing example actual measurements of control results when the constant-jerk-based successive key depression trajectory, described above with reference to section (a) of FIG. 3, were reproduced through the servo control of FIG. 4. In the figure, a broken line indicates the position component (target position value rx) of the successive key depression trajectory data, and a solid line indicates the actual position measurement yxk of the position of the key 1 depressed in rapid succession. Further, in the figure, a one-dot-dash line indicates the velocity component (target velocity value rv) of the successive key depression trajectory data, and a two-dot-dash line indicates the acceleration component (target acceleration value ra) of the successive key depression trajectory data. Further, the horizontal axis in FIG. 4 represents the time t. As set forth above, the key release slow-down trajectory and key depression slow-up trajectory based on the constant jerk, proposed in accordance with the present invention, can impart the key with smooth dynamic variation throughout the overall successive key depression trajectory by continuously varying the acceleration component (target acceleration value ra). In this way, it is possible to obtain the actual measurement yxk of position data of the key 1 that is extremely close to the target position value rx, as illustrated in FIG. 5. Thus, the constant jerk successive key depression trajectory proposed in accordance with the present invention permits smooth depression of the key and thereby achieve an improved successive key depression performance capability. Further, by achieving smooth (continuous) acceleration variation of the key, the instant embodiment can minimize the prior art problem that the string striking speed would increase during the successive key depression.

Figure 6:
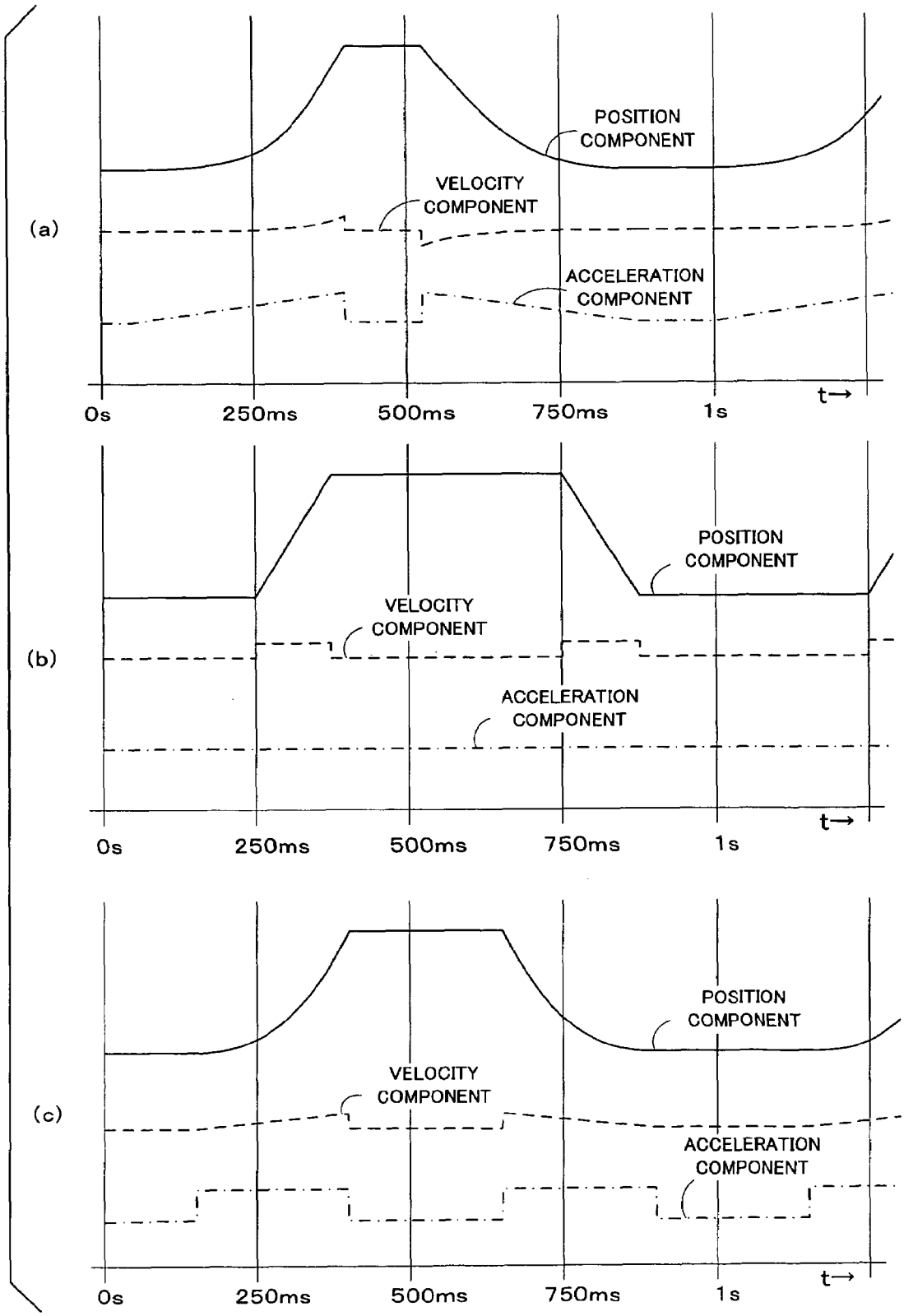
FIG. 6 is a diagram explanatory of a modification of the embodiment of the present invention, where section (a) shows a trajectory when a constant-jerk-based trajectory proposed by the present invention is applied to a single key depression performance, section (b) shows a conventionally-known constant-velocity-based trajectory representative of a single depression of a key and (c) shows a conventionally-known constant-acceleration-based trajectory representative of a single depression of a key.

Whereas the foregoing paragraphs have described the creation of the constant-jerk-based successive key depression trajectory, the constant jerk trajectory of the present invention is not limited to the above-described application and may also be applied to a single full-stroke key depression as illustrated in sections (a)-(c) of FIG. 6. Sections (a)-(c) of FIG. 6 show trajectories for allowing a single depression of a key at a final key velocity of 80 mm/s. More specifically, sections (a)-(c) of FIG. 6 show trajectories along which the key is depressed from the rest position (i.e., key position of a zero-mm stroke amount) to the end position (i.e., key position 10 mm lower than the rest position), temporarily stopped at the end position for a given time and then returned (released back to) to the rest position. Still more specifically, section (a) of FIG. 6 indicates a trajectory based on a constant jerk, section (b) indicates a trajectory based on a constant velocity, and section (b) indicates a trajectory based on constant acceleration. In each of sections (a)-(c) of FIG. 6, a solid line indicates a position component of the trajectory, a broken line indicates a velocity component of the trajectory, and a one-dot-dash indicates an acceleration component of the trajectory.

As seen in section (a) of FIG. 6, in accordance with the constant-jerk-based key depression slow-up trajectory, the key 1 starts moving at the rest position x0 (zero-mm stroke amount) at an initial velocity v0 of 0 mm/s and with an initial acceleration a0 of 0 mm/^s ("s^2" indicates the square of the second (s)) and stops moving at the end position x1 (10 mm stroke amount) at a final velocity v1 of 80 mm/s and with a final acceleration a1 of about 427 mm/s^2. This trajectory takes a form of a slow-up trajectory held in a constant (uniform) jerk j0 of about 1,138 mm/s^3("s^3" indicates the cube of the second(s)). Time taken for the key to move from the rest position x0 to the end position x1 along this trajectory is 375 ms. At the time of release operation of the key, the trajectory takes a form of a slow-down trajectory in accordance with which the key 1 starts moving at the end position x1 at an initial velocity v2 of −80 mm/s and with an initial acceleration a2 of about 427 mm/s^2 and stops moving at the rest position x0 at a final velocity v3 of 0 mm/s and with a final acceleration a3 of 0 mm/s^2. Time taken for the key to move from the end position x1 to the rest position x0 along this trajectory is 375 ms.

In the case of the constant-velocity-based trajectory illustrated in section (b) of FIG. 6, the key starts moving at the rest position x0 at an initial velocity v0 of 80 mm/s and moves to the end position x1 at the constant velocity v0 of 80 mm/s, and a time taken for the key to move from the rest position x0 to the end position x1 along this trajectory is 125 ms. In the constant-velocity-based trajectory at the time of release operation of the key 1, the key 1 moves from the end position x1 to the rest position xO at the constant velocity v2 of −80 mm/s, and a time taken for the key to move from the end position x1 to the end position x0 along this trajectory is 125 ms. Further, in the case of the constant-acceleration-based trajectory illustrated in section (c) of FIG. 6, the key starts moving at the rest position x0 at an initial velocity v0 of 0 mm/s, moves to the end position x1 with a constant acceleration of 320 mm/s^2, and stops moving at the end position x1 at a final velocity v1 of 80 mm/s. Time taken for the key to move from the rest position x0 to the end position x1 along this trajectory is 250 ms. In accordance with the key release slow-down trajectory, the key starts moving at the end position x1 at an initial velocity v2 of −80 mm/s, slows down with a constant acceleration of 320 mm/s^2, and stops moving at the rest position x0 at a final velocity v1 of 80 mm/s. Time taken for the key to move from the end position x1 to the rest position x0 along this trajectory is 250 ms.

As apparent from sections (a)-(c) of FIG. 6, the constant-jerk-based trajectory can express slow-up and slow-down trajectories with moderate velocities as compared to the constant-velocity-based trajectory and constant-acceleration-based trajectory. Thus, with the constant-jerk-based trajectory proposed in accordance with the present invention, it is possible to reproduce a single key depression with an increased smoothness, and it is possible to generate a performance tone with, for example, a softer tone color by depicting a more thorough key depression of a soft finger touch. Further, with the constant-jerk-based trajectory proposed in accordance with the present invention, it is also possible to reproduce key release operation with increased slowness and calmness, which, for example, can reproduce moderate attenuation of a tone in response to damping operation. In this way, the instant embodiment can reproduce moderate key depression and key release operations; for example, the instant embodiment can use the trajectory data to express smooth key depression and key release operations performed by a human player with feeling. As a result, the instant embodiment of the automatic piano can reproduce a feeling etc. of a human player with an increased subtlety and precision.

The example trajectory illustrated in sections (a) to (d) of FIG. 3 has been described in relation to creation of a half-stroke successive key depression performance in which the key starts to be released at the end position and then the key is again fully depressed to the end position without being completely returned to the rest position (namely, in which key release operation and key depression operation is repeated with the key depressed halfway). However, the successive key depression trajectory, which can be applied to the present invention, is not limited to the above-described and may be of any other types, such as one in accordance with which a key starts to be depressed at the rest position, then starts to be released without being completely depressed to the end position and is then returned to the rest position. Further, whereas the successive key depression trajectory has been described in relation to the case where part of the trajectory is represented by a constant velocity trajectory, the present invention is not so limited, and the whole of the key depression stroke and key release stroke may be represented by a constant jerk trajectory. Furthermore, the present invention may be arranged to permit a single key depression performance in which a depression of the key is effected in accordance with a constant-velocity key depressing trajectory and a release of the key, following the key depression, is effected in accordance with a constant-jerk-based key releasing slow-down trajectory. Moreover, the present invention may be arranged to permit a single key depression performance in which a depression of the key is effected in accordance with a constant-jerk-based key depressing slow-up trajectory and a release of the key, following the key depression, is effected in accordance with a constant-velocity key releasing slow-down trajectory. Moreover, the present invention may be arranged to permit a single key depression performance in which a release of the key is effected in accordance with a constant-velocity key releasing slow-down trajectory and a depression of the key, following the key release, is effected in accordance with a constant-jerk-based key depressing slow-up trajectory. In addition, the present invention may be arranged to permit a single key depression performance in which a release of the key is effected in accordance with a constant-jerk-based key releasing slow-down trajectory and a depression of the key, following the key release, is effected in accordance with a constant-velocity key depressing trajectory. What is more, the present invention may be arranged to permit a successive key depression performance comprising a combination of these single key depression performances.

Whereas the foregoing paragraphs have described creation of trajectory data for driving the key 1, the present invention is not so limited. For example, the constant-jerk-based trajectory proposed by the present invention may be applied to creation of trajectory data for automatically driving a pedal etc. Further, the automatic piano of the present invention may be in the form of either a grand piano or an upright piano.

What is claimed is:

1. An automatic piano comprising:

a plurality of keys;

a drive device that individually drives the plurality of keys;

a first-order trajectory data generation section that, on the basis of performance information, generates first-order trajectory data indicative of variation over time of position, velocity and acceleration components of a particular one of the keys to be automatically operated, in order to define movement of the particular key;

a second-order trajectory data generation section that, on the basis of the acceleration component in said first-order trajectory data, calculates a jerk component related to the movement of the particular key, modifies said first-order trajectory data with the calculated jerk component and generates the modified first-order trajectory data as second-order trajectory data; and a control device that, on the basis of said second-order trajectory data, urges said drive device to drive the particular key, whereby the particular key is automatically operated along a trajectory corresponding to said second-order trajectory data.

2. An automatic piano as claimed in claim 1 wherein a trajectory represented by said first-order trajectory data includes a constant acceleration section, and wherein said second-order trajectory data generation section calculates the jerk component, on the basis of an acceleration component in the constant acceleration section, such that the acceleration is caused to gradually vary in the constant acceleration section and, on the basis of the calculated jerk component, generates said second-order trajectory data such that the acceleration varies in a section corresponding to the constant acceleration section in said first-order trajectory data.

3. An automatic piano as claimed in claim 2 wherein the jerk component is a value indicative of variation, per unit time, of the acceleration, and wherein, by incrementing or decrementing said value, said first-order trajectory data is modified so that the acceleration gradually varies, to thereby generate said second-order trajectory data such that the acceleration varies in the section corresponding to the constant acceleration section.

4. An automatic piano as claimed in claim 1 wherein said first-order trajectory data generation section calculates a constant-velocity key depressing trajectory for depressing the particular key at a constant velocity and a constant-velocity key releasing trajectory for releasing the particular key at a constant velocity, then sets, as a constant acceleration section, a given section including an intersection between the constant-velocity key depressing trajectory and the constant-velocity key releasing trajectory to thereby calculate a constant acceleration trajectory where a transition occurs from a key depression phase to a key release phase, and then generates said first-order trajectory data by combining the constant-velocity key depressing trajectory, the constant-velocity key releasing trajectory and the constant acceleration trajectory, and wherein said second-order trajectory data generation section sets the jerk component to take a given value in the constant acceleration section, then modifies an acceleration trajectory in the constant acceleration section so that the acceleration gradually vary in accordance with the given value of the jerk component, and then generates said second-order trajectory data by modifying said first-order trajectory data in accordance with the modification of the acceleration trajectory.

5. An automatic piano as claimed in claim 1 wherein said control device servo-controls said drive device in accordance with position, velocity and acceleration components included in said second-order trajectory data.

6. A method for, on the basis of performance information, automatically operating a key in an automatic piano which includes a plurality of keys and a drive device that individually drives the plurality of keys, said method comprising:

a step of, on the basis of performance information, generating first-order trajectory data indicative of variation over time of position, velocity and acceleration components of a particular one of the keys to be automatically operated, in order to define movement of the particular key;

a step of, on the basis of the acceleration component in said first-order trajectory data, calculating a jerk component related to the movement of the particular key and generating second-order trajectory data by modifying said first-order trajectory data with the calculated jerk component; and a step of, on the basis of said second-order trajectory data, controlling said drive device to drive the particular key.

7. A program containing a group of instructions for causing a computer to perform a procedure for, on the basis of performance information, automatically operating a key in an automatic piano which includes a plurality of keys and a drive device that individually drives the plurality of keys, said procedure comprising:

a step of, on the basis of performance information, generating first-order trajectory data indicative of variation over time of position, velocity and acceleration components of a particular one of the keys to be automatically operated, in order to define movement of the particular key;

a step of, on the basis of the acceleration component in said first-order trajectory data, calculating a jerk component related to the movement of the particular key and generating second-order trajectory data by modifying said first-order trajectory data with the calculated jerk component; and a step of, on the basis of said second-order trajectory data, controlling said drive device to drive the particular key, wherein said drive device is driven, on the basis of said second-order trajectory data, to move the particular key.

* * * * *